US009216498B2

(12) United States Patent
Wu

(10) Patent No.: US 9,216,498 B2
(45) Date of Patent: Dec. 22, 2015

(54) TUBE CLAMP DETACHING TOOL

(71) Applicant: Pi-Liang Wu, Taichung (TW)

(72) Inventor: Pi-Liang Wu, Taichung (TW)

( * ) Notice: Subject to any disclaimer, the term of this patent is extended or adjusted under 35 U.S.C. 154(b) by 0 days.

(21) Appl. No.: 14/509,049

(22) Filed: Oct. 8, 2014

(65) Prior Publication Data

US 2015/0101185 A1 Apr. 16, 2015

(30) Foreign Application Priority Data

Oct. 15, 2013 (TW) ..... 102140596 A

(51) Int. Cl.

| | |
|---|---|
| ***B25B 25/00*** | (2006.01) |
| ***B25B 27/20*** | (2006.01) |
| *B25B 5/02* | (2006.01) |
| *B25B 3/00* | (2006.01) |

(52) U.S. Cl.

CPC ..... *B25B 25/005* (2013.01); *B25B 27/20* (2013.01); *B25B 3/00* (2013.01); *B25B 5/02* (2013.01)

(58) Field of Classification Search

CPC .... B21D 39/046; B25B 27/146; B25B 27/20; B25B 27/205; B25B 31/00; B25B 5/102; B25B 25/00; B25B 25/005; B25B 3/00; B25B 5/02; B25B 1/24; B25B 1/20; Y10T 29/5367; Y10T 29/53783; Y10T 29/53852; Y10T 29/53987

USPC ..... 29/237, 243.56, 257, 282; 269/188, 269/189, 246; 81/9.3

See application file for complete search history.

(56) References Cited

U.S. PATENT DOCUMENTS

| | | | | |
|---|---|---|---|---|
| 1,150,962 | A * | 8/1915 | Pederson | 269/128 |
| 2,677,982 | A * | 5/1954 | Arras et al. | 81/9.3 |
| 2,698,550 | A * | 1/1955 | Hill | 269/103 |
| 3,596,686 | A | 8/1971 | Blumenfeld et al. | |
| 3,800,634 | A * | 4/1974 | Clayton | 81/9.3 |
| 4,360,313 | A * | 11/1982 | Satzler | 414/781 |
| 4,610,187 | A * | 9/1986 | Spaulding | 81/9.3 |
| 4,742,736 | A * | 5/1988 | Williams | 81/303 |
| 4,785,694 | A * | 11/1988 | Burmester | 81/485 |
| 6,164,162 | A * | 12/2000 | Furundzic | 81/9.3 |
| 6,179,279 | B1 * | 1/2001 | Asai et al. | 269/164 |
| 6,370,985 | B1 * | 4/2002 | Wu | 81/9.3 |
| 6,415,830 | B1 * | 7/2002 | Adamshick | 144/135.2 |
| 6,634,258 | B2 * | 10/2003 | Pool et al. | 81/9.3 |
| 7,013,771 | B2 * | 3/2006 | Wu | 81/486 |

(Continued)

FOREIGN PATENT DOCUMENTS

| | | |
|---|---|---|
| CN | 203228167 U | 10/2013 |
| GB | 2283795 | 5/1995 |

(Continued)

*Primary Examiner* — Lee D Wilson
*Assistant Examiner* — Jamal Daniel

(57) ABSTRACT

A tube clamp detaching tool comprising a base, a movable member, a screw stem, a fixed jaw is formed at one end of the base, a holding block protrudes from the other end, and an elongated guide groove, the movable member is pivotal inserted into the guide groove, the movable member is provided with a movable jaw, the movable jaw is positioned relative to the fixed jaw, the screw stem is screwed into the holding block, and one end of the screw stem is pivotal joined to the movable member, the movable jaw is indented with a first inserting groove, the first inserting groove of the movable jaw is further indented with a cavity, the fixed jaw is indented with a second inserting groove to correspond to one side of the movable jaw, a first bolt is screwed into one side of the movable jaw and enters the cavity.

5 Claims, 6 Drawing Sheets

(56) References Cited

U.S. PATENT DOCUMENTS

| | | | | |
|---|---|---|---|---|
| 7,093,518 | B2 * | 8/2006 | Gmeilbauer | 81/9.3 |
| 7,104,162 | B1 * | 9/2006 | Wu | 81/9.3 |
| 2007/0227309 | A1 * | 10/2007 | Teeters | 81/9.3 |
| 2008/0041198 | A1 * | 2/2008 | Wu | 81/486 |

FOREIGN PATENT DOCUMENTS

| | | | |
|---|---|---|---|
| TW | 86954 | | 5/1987 |
| TW | 240506 | | 2/1995 |
| TW | 530726 | | 5/2003 |
| TW | 567936 | | 12/2003 |
| TW | M260364 | | 4/2005 |
| TW | M287208 | | 2/2006 |
| TW | M381483 | | 6/2010 |
| TW | 201309932 | A | 3/2013 |
| WO | 97/13092 | A1 | 4/1997 |
| WO | 98/34761 | A2 | 8/1998 |

* cited by examiner

TUBE CLAMP DETACHING TOOL

BACKGROUND OF THE INVENTION (a) Field of the Invention

The present invention relates to a tool used when detaching pipe fittings, and more particularly to a tube clamp detaching tool. The tube clamp detaching tool is used to flexibly expand a tube clamp fitted over the circumference of a flexible tube to facilitate pulling out and detaching flexible tubes.

(b) Description of the Prior Art

With the various types of fluid delivery tubing, a variety of adapter tubes (such as: T-branch tubes, bend connecting tubes) are often seen used to connect the flexible tubes together, or the flexible tubes are coupled to the tube fitting areas of various types of containers, valve components, and the like. In order ensure that the couplings between the flexible tubes and the aforementioned tubing matching parts, such as the adapter tubes or tube fittings, are firm and will not come loose, in general, a tube clamp is bound and fitted over the circumference of the end portions of the flexible tubes. The material properties of the tube clamp and the flexible tube are used to enable a tight connection between the flexible tube and the pipe fitting to ensure the connection does not come loose.

A tube clamp shown in FIG. 1 is commonly seen bound and fitted to the lower water pipe of a car radiator, and has an approximately annular main body (1). The body (1) is structured from a metal sheet, and the two ends of the metal sheet are bent towards each other to form a circular shape. A first ear piece (11) is bent and extends outward from one end of the main body (1). A rectangular though hole (12) penetrates the main body (1), and an indentation (13) penetrates the first ear piece (11) adjacent to one side thereof. The indentation (13) and the though hole (12) are connected to form one hole. The first ear piece (11) forms a limiting portion (14) at one side of the indentation (13). The other end of the main body (1) extends into the though hole (12), and a second ear piece (15) is bent and extends outward from this other end. A retaining portion (16) protrudes outward from the main body (1) at one side of the second ear piece (15). The retaining portion (16) is positioned relative to the indentation (13), and the retaining portion (16) is delimited between the first ear piece (11) and the second ear piece (15), as shown in FIGS. 2 and 3. In addition, an embedding hole (17) is formed in the limiting portion (14).

When the aforementioned tube clamp is fitted to a flexible tube, the main body (1) uses its material flexibility to tightly bind and fit on the outer periphery of the flexible tube, thereby enabling the flexible tube to be tightly connected to a tube fitting.

In order to achieve the objective of replacing the flexible tube or the tube fitting, when it is required to separate the flexible tube from the tube fitting, then the restraint of the tube clamp on the flexible tube must be first removed, at which time the corresponding clamped first and second ear pieces (11), (15) draw close to each other, which causes the annular shaped main body (1) to flexibly expand and deform, thereby removing the restraint of the main body (1) on the flexible tube to facilitate subsequent detachment of the flexible tube.

When the corresponding clamped first and second clamp pieces (11), (15) draw close to each other causing the main body (1) to flexibly expand and deform, then the retaining portion (16) is displaced toward the indentation (13), whereupon the retaining portion (16) passes through the indentation (13). And when the first clamp piece (11) is positioned between the second clamp piece (15) and the retaining portion (16), then the retaining portion (16) is pushed sideward, causing the retaining portion (16) to be positioned relative to the limiting portion (14). At this time, the clamping force of the first and second clamp pieces (11), (15) is released, and the flexible restoring force of the main body (1) causes the retaining portion (16) to retain the limiting portion (14), and the end of the retaining portion (16) embeds into the embedding hole (17), thereby fixedly positioning the retaining portion (16) and enabling the main body (1) to maintain an expanded state, thus providing for convenient replacement or maintenance of the flexible tube or the pipe fitting.

SUMMARY OF THE INVENTION

In order to provide for convenient detachment of a tube clamp from a flexible tube, the main objective of the present invention lies in providing a tube clamp detaching tool, which is used to enable the easy removal of a tube clamp from a flexible tube.

The present disclosure relates to a tube clamp detaching tool, which is used to enable detachment of a tube clamp from a flexible tube, the tube clamp is provided with an annular strip, one end of the strip is provided with a first ear piece, and the other end of the strip is provided with a second ear piece, the other end forms a retaining portion, the tube clamp detaching tool comprises a base, a movable member, and a screw stem, wherein a fixed jaw is formed at one end of the base, and a holding block protrudes from the other end; the base is provided with an elongated guide groove between the fixed jaw and the holding block, the movable member is pivotal inserted into the guide groove, thereby enabling the movable member to be movable joined to the base, the movable member is provided with a movable jaw, and the movable jaw is positioned relative to the fixed jaw, the screw stem is screwed into the holding block, and one end of the screw stem is pivotal joined to the movable member, the screw stem is used to control back and forth displacement of the movable member along the guide groove, the movable jaw is indented with a first inserting groove to correspond to one side of the fixed jaw, and the first inserting groove is used to contain and fixedly position the first ear piece of the tube clamp, the inserting groove of the movable jaw is further indented with a cavity, and the cavity is used to contain the retaining portion of the tube clamp, the fixed jaw is indented with a second inserting groove to correspond to one side of the movable jaw, and the second inserting groove is used to contain the second ear piece of the tube clamp, a first bolt is screwed into one side of the movable jaw and enters the cavity, thereby causing the first bolt to abut against and displace the retaining portion sidewards.

Preferably, an insertion piece protrudes from the bottom side of the movable jaw of the movable member, and the insertion piece is pivotal inserted into the guide groove.

Preferably, a bolt fastens down a washer to the bottom end of the insertion piece, and the washer is adjacent to the bottom side of the base.

Preferably, the screw stem is provided with a turn bolt head, and the turn bolt head is used to operate rotation of the screw stem.

Preferably, the fixed jaw and the holding block are opposite to each other.

Preferably, a second bolt is screwed into another side of the movable jaw; the first bolt and the second bolt respectively pass into the cavity from two sides thereof, and are thus able to respectively abut against and displace the retaining portion sidewards.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 4:
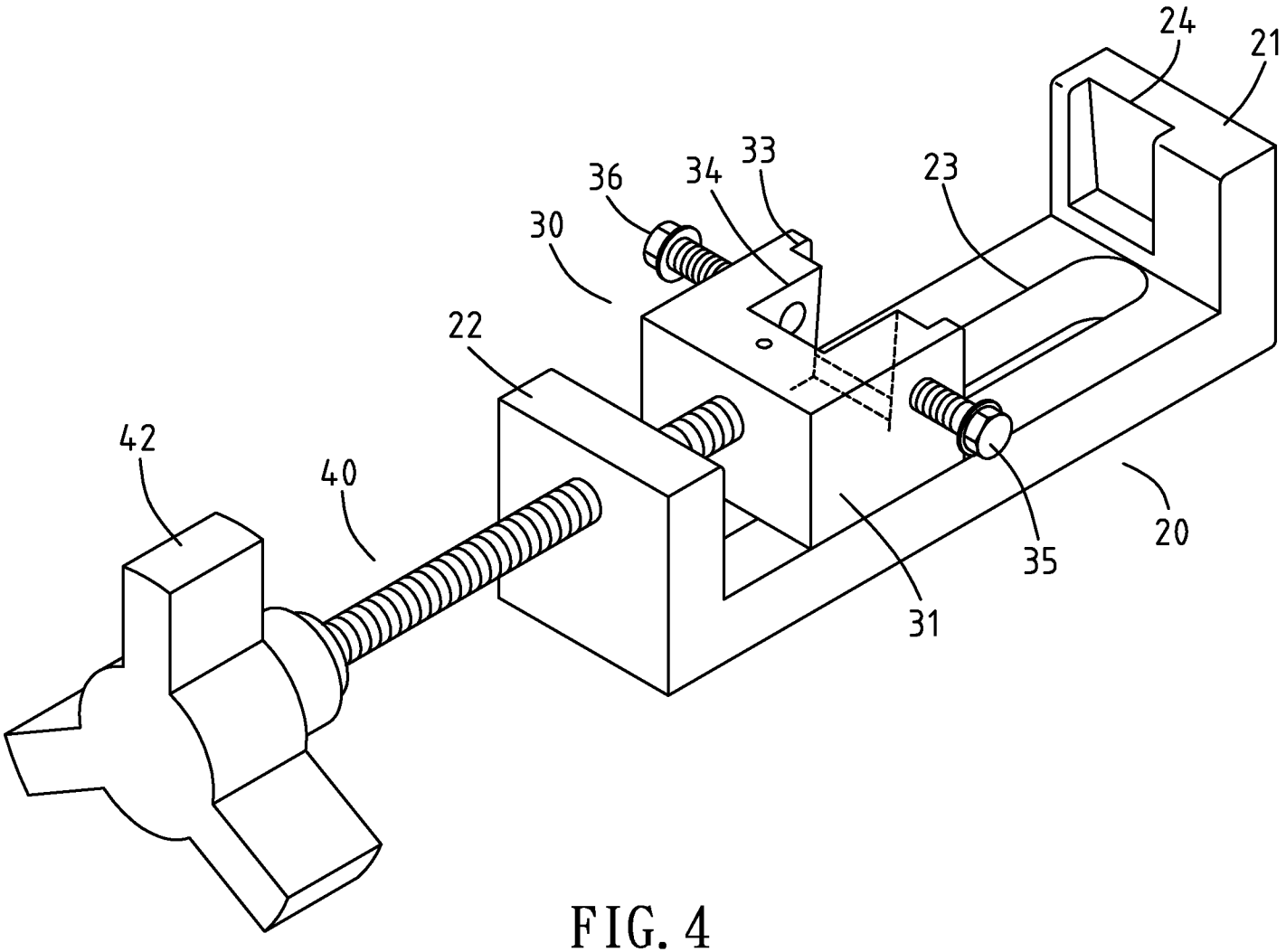
FIG. 4 shows an elevational view of an embodiment of the present invention.
Figure 5:
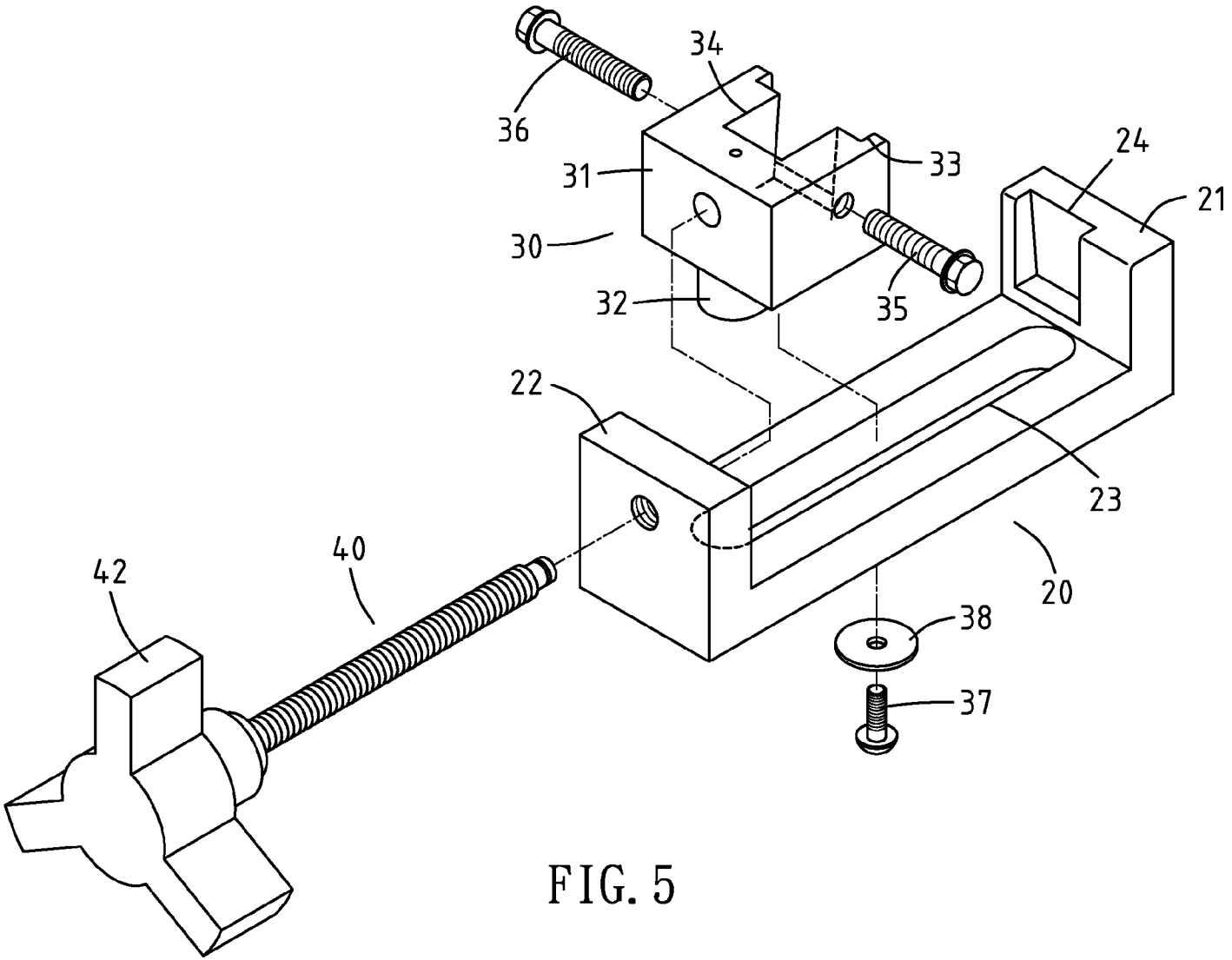
FIG. 5 is an exploded elevational view of the embodiment of the present invention.
Figure 6:
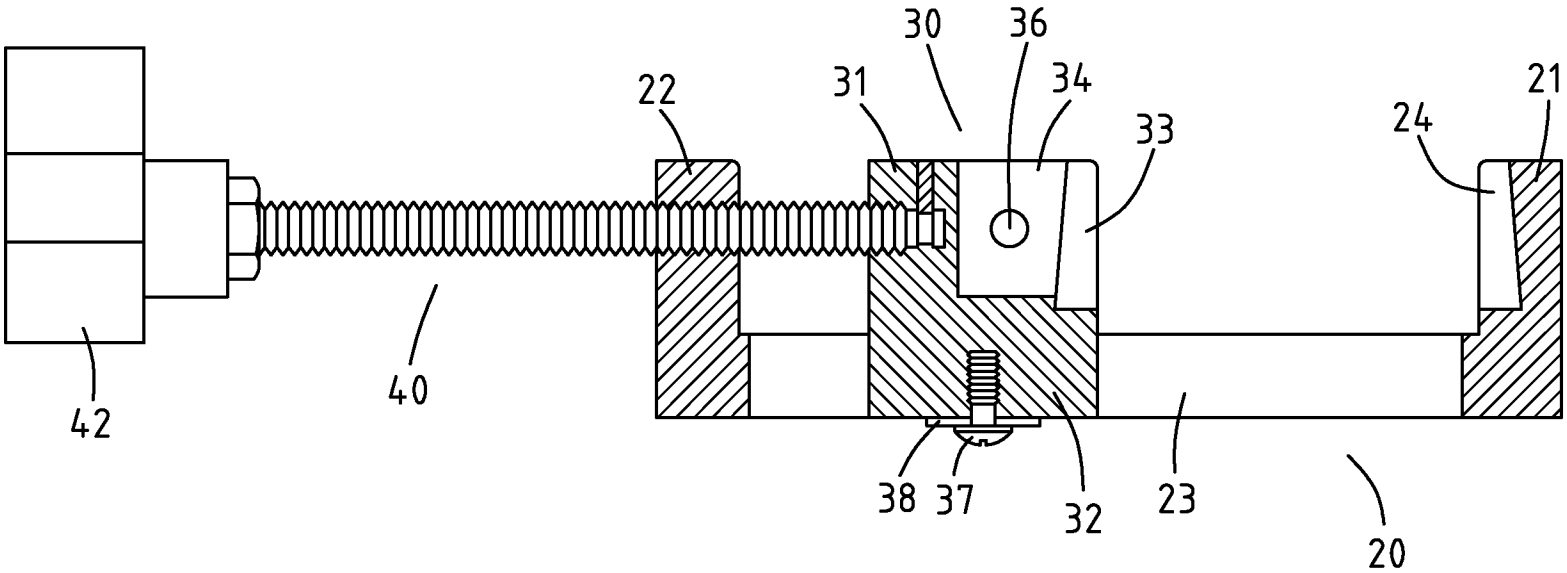
FIG. 6 is a cutaway view in an axial direction of the embodiment of the present invention.

Referring to FIG. 4, FIG. 5, and FIG. 6, which show an embodiment of the present invention comprising a base (20), a movable member (30), and a screw stem (40); wherein one end of the base (20) is configured with a fixed jaw (21), and a holding block (22) protrudes from the other end. The fixed jaw (21) and the holding block (22) are opposite to each other. The base (20) is provided with an elongated guide groove (23) between the fixed jaw (21) and the holding block (22). The movable member (30) is movable joined to the base (20). The movable member (30) is provided with a movable jaw (31), and the movable jaw (31) is positioned relative to the fixed jaw (21). An insertion piece (32) protrudes from the bottom side of the movable jaw (31) of the movable member (30). The insertion piece (32) is pivotal inserted into the guide groove (23). The screw stem (40) is screwed into the holding block (22), and one end of the screw stem (40) is pivotal joined to the movable member (30). The other end of the screw stem (40) is provided with a turn bolt head (42). Accordingly, operating the turn bolt head (42) causes the screw stem (40) to correspondingly rotate into the holding block (22), thereby enabling the screw stem (40) to control back and forth displacement of the movable member (30) along the guide groove (23) between the fixed jaw (21) and the holding block (22).

The movable jaw (31) is indented with a first inserting groove (33) to correspond to one side the fixed jaw (21). The first inserting groove (33) is used to contain and fixedly position a first ear piece of a tube clamp. The first inserting groove (33) of the movable jaw (31) is further indented with a cavity (34), which is used to contain a retaining portion of the tube clamp.

The fixed jaw (21) is indented with a second inserting groove (24) to correspond with one side the movable jaw (31). The second inserting groove (24) is used to contain a second ear piece of the tube clamp. A first bolt (35) is screwed into one side of the movable jaw (31) and a second bolt (36) is screwed into another side. Moreover, the first bolt (31) and the second bolt (36) respectively pass into the cavity (34) from two sides thereof, thereby respectively abutting against the retaining portion of the tube clamp and displacing the retaining portion sidewards.

A bolt (37) fastens down a washer (38) to the bottom end of the insertion piece (32), and the washer (38) is adjacent to the bottom side of the base (20), thus enabling the insertion piece (32) to be pivotal inserted into the guide groove (23) and be securely positioned therein.

Use of the detaching tool of the present invention causes a main body (1) of a tube clamp to expand, thereby enabling the tube clamp to be detached from a flexible tube.

Figure 7:
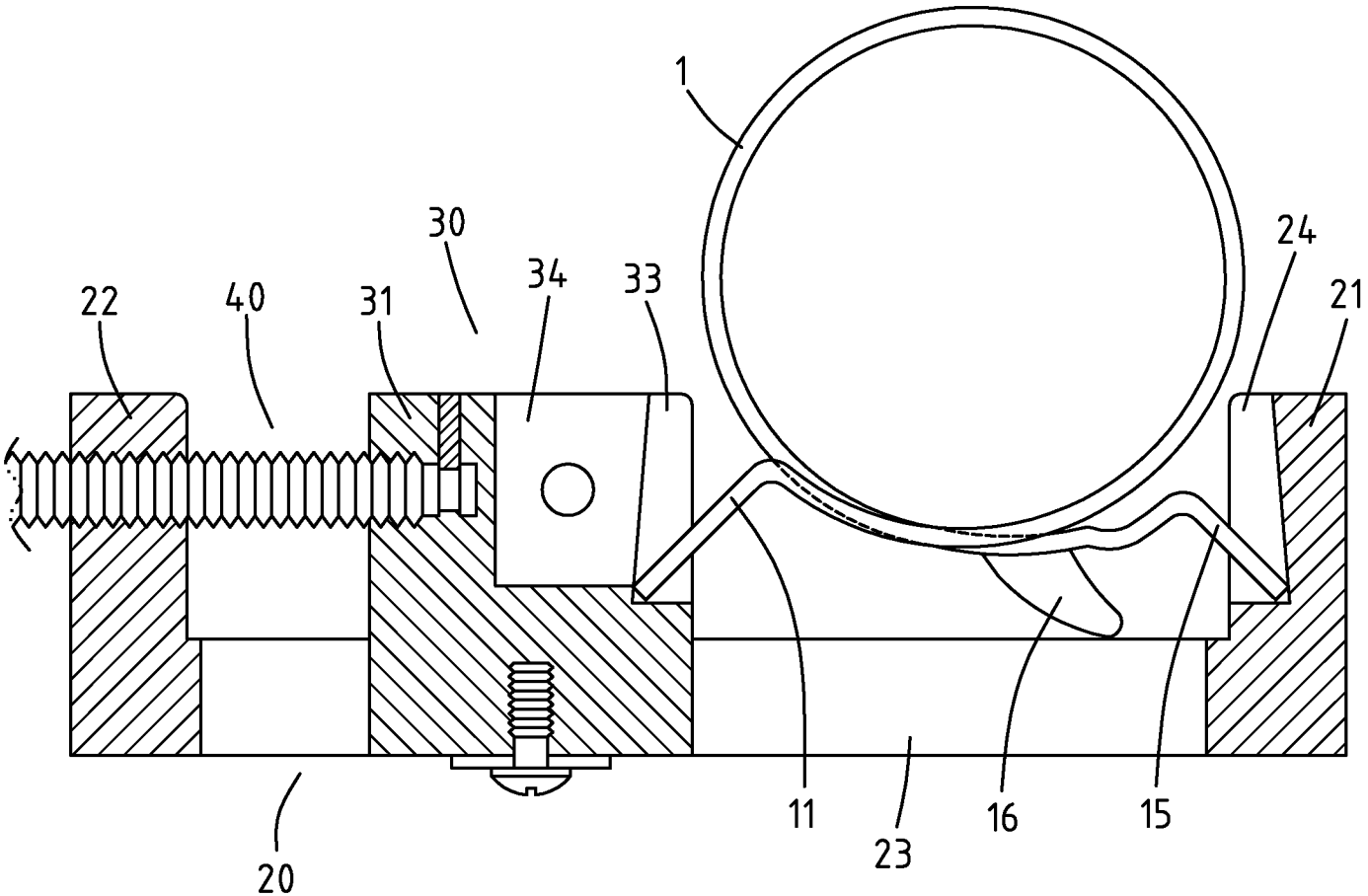
FIG. 7 is a cutaway schematic view in an axial direction of an operating state of the embodiment according to the present invention.

Operating the turn bolt head (42) rotates the screw stem (40) which actuates and displaces the movable member (30), thereby adjusting the distance between the fixed jaw (21) and the movable jaw (31), as shown in FIG. 7. When the tube clamp detaching tool of the present invention is used to expand the main body (1) of the tube clamp to facilitate detachment of the flexible tube (not shown in the drawings), then a first ear piece (11) abuts against the movable jaw (31) and is embedded into the first inserting groove (33). Moreover, the second ear piece (15) abuts against the fixed jaw (21) and is embedded into the second inserting groove (24). After which further rotation of the screw stem (40) further displaces the movable jaw (31) towards the fixed jaw (21). Accordingly, the movable jaw (31) and the fixed jaw (21) are used to squeeze the first ear piece (11) and the second ear piece (15) from opposite directions. The opposing displacements of the first ear piece (11) and the second ear piece (15) toward each other cause the main body (1) to flexibly expand and deform, thereby achieving the objective of loosening and detaching the main body (1) from the flexible tube. Furthermore, during the process of the main body (1) expanding and deforming, the first ear piece (11) and the second ear piece (15) are respectively propped up against the movable jaw (31) and the fixed jaw (21), and the first ear piece (11) and the second ear piece (15) are effectively positioned between the movable jaw (31) and the fixed jaw (21), thereby improving operational convenience when loosening and detaching the tube clamp.

Figure 1:
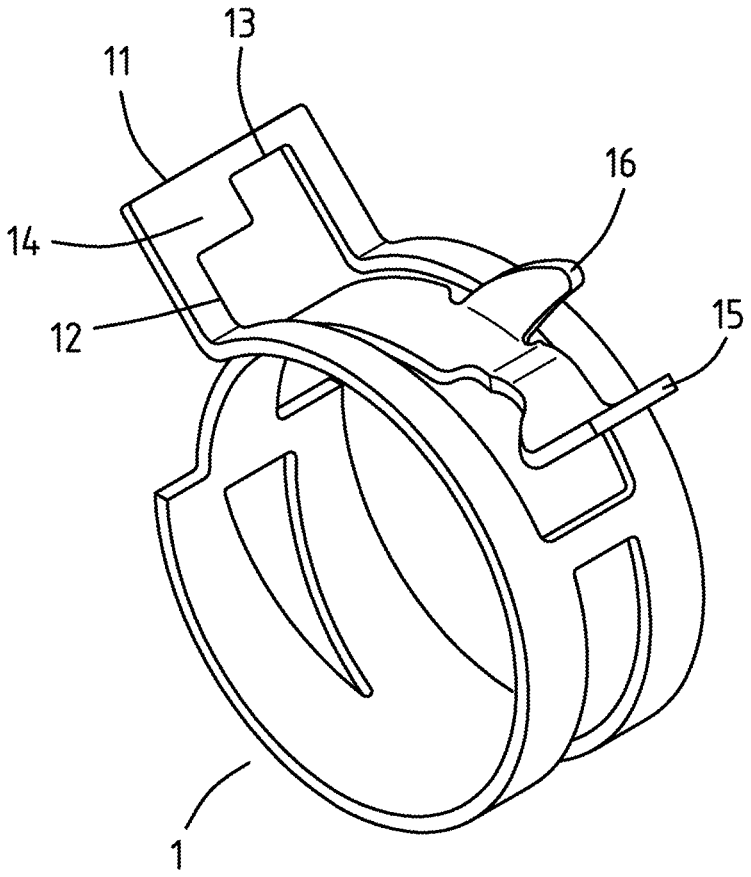
FIG. 1 PRIOR ART
FIG. 1 is an elevational view of a tube clamp of the prior art.
Figure 2:
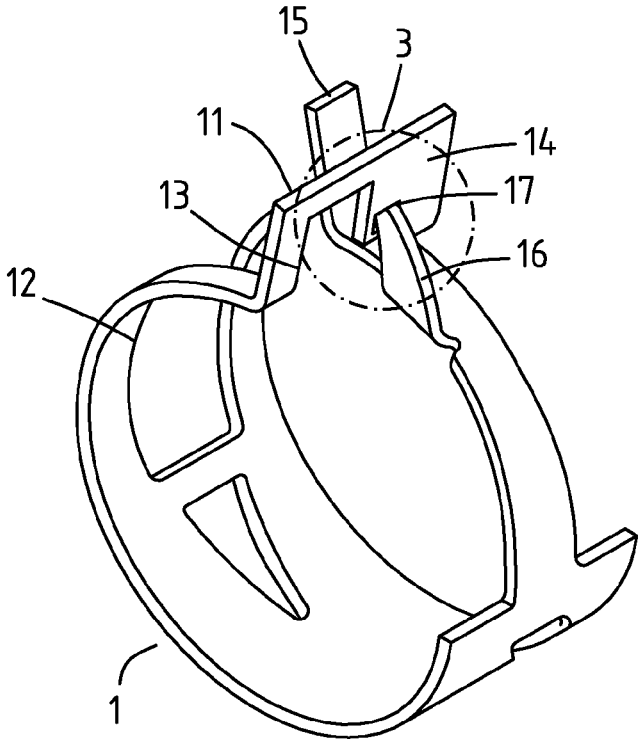
FIG. 2 PRIOR ART
FIG. 2 is a schematic view depicting an operating state of the tube clamp of the prior art when the main body has been expanded.
Figure 3:
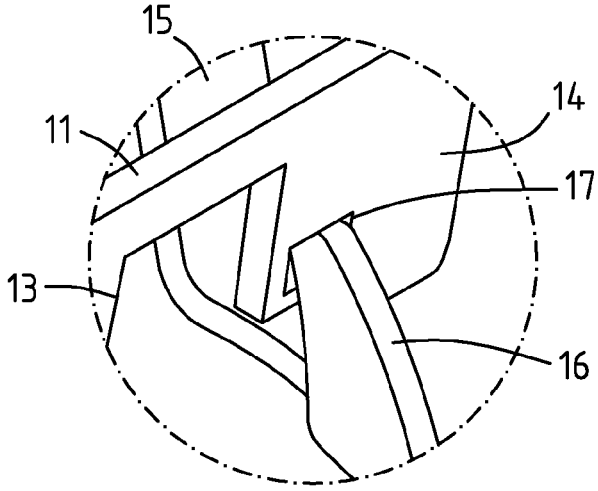
FIG. 3 PRIOR ART
FIG. 3 is a partial enlarged view of FIG. 2.

The corresponding clamped first and second clamp pieces (11), (15) cause the main body (1) to flexibly expand and deform, thereby displacing a retaining portion (16) toward an indentation (13) (as shown in FIG. 1, FIG. 2, and FIG. 3). When the retaining portion (16) passes through the indentation (13) and enters the cavity (34), then the first clamp piece (11) is positioned between the second clamp piece (15) and the retaining portion (16). The first bolt (35) is then rotated to cause the front end of the first bolt (35) to enter the cavity (34), whereby the first bolt (35) is used to push the retaining portion (16) sidewards and cause the retaining portion (16) to be positioned relative to the limiting portion (14). At which time, if the screw stem (40) is reverse rotated, then the movable member (30) is caused to displace in a direction away from the fixed jaw (21), which expands the distance between the fixed jaw (21) and the movable jaw (31). Because the retaining portion (16) is retained by the limiting portion (14) and is inserted and retained in an insertion hole (17), thus, the main body (1) separates from the detaching tool. The main body (1) still maintains an expanded state, thereby achieving the operational convenience of enabling replacement or maintenance of the flexible tube or the pipe fitting.

Furthermore, the embodiment of the present invention can also be used to assemble the tube clamp to a flexible tube. According to the aforementioned operating procedure whereby the main body (1) is made to flexibly expand and deform, causing the retaining portion (16) to be retained by the limiting portion (14), then the tube clamp can be annular fitted on to the outer periphery of the flexible tube. The first bolt (35) is then reverse rotated to cause the first bolt (35) to withdraw from the cavity (34), and the second bolt (36) is rotated to cause the front end of the second bolt (36) to enter the cavity (34), thereby pushing the retaining portion (16) sidewards and causing the retaining portion (16) to be positioned relative to the indentation (13). The screw stem (40) is then reverse rotated to cause the movable member (30) to displace in a direction away from the fixed jaw (21) and expand the distance between the fixed jaw (21) and the movable jaw (31), thereby gradually reducing the annular inner diameter of the body (1). Accordingly, installation of the tube clamp is completed when the main body (1) has tightened the tube clamp on the flexible tube.

The tube clamp detaching tool of the present invention is used to enable the simple and easy fitting of a tube clamp to a flexible tube or detachment therefrom.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A tube clamp detaching tool, which is used to enable detachment of a tube clamp from a flexible tube, the tube clamp is provided with an annular strip, one end of the strip is provided with a first ear piece, and the other end of the strip is provided with a second ear piece, the other end forms a retaining portion, the tube clamp detaching tool comprises a base, a movable member, and a screw stem, wherein a fixed jaw is formed at one end of the base, and a holding block protrudes from the other end; the base is provided with an elongated guide groove between the fixed jaw and the holding block; the movable member is pivotal inserted into the guide groove, thereby enabling the movable member to be movable joined to the base; the movable member is provided with a movable jaw, and the movable jaw is positioned relative to the fixed jaw; the screw stem is screwed into the holding block, and one end of the screw stem is pivotal joined to the movable member, the screw stem is used to control back and forth displacement of the movable member along the guide groove;

the movable jaw is indented with a first inserting groove to correspond to one side of the fixed jaw, and the first inserting groove is used to contain and fixedly position the first ear piece of the tube clamp; the inserting groove of the movable jaw is further indented with a cavity, and the cavity is used to contain the retaining portion of the tube clamp; the fixed jaw is indented with a second inserting groove to correspond to one side of the movable jaw, and the second inserting groove is used to contain the second ear piece of the tube clamp; a first bolt is screwed into one side of the movable jaw and enters the cavity, thereby causing the first bolt to abut against and displace the retaining portion sidewards: an insertion piece protrudes from the bottom side of the movable jaw of the movable member, and the insertion piece is pivotal inserted into the guide groove.

2. The tool as claimed in claim 1, wherein a bolt fastens down a washer to the bottom end of the insertion piece, and the washer is adjacent to the bottom side of the base.

3. The tool as claimed in claim 1, wherein the screw stem is provided with a turn bolt head, and the turn bolt head is used to operate rotation of the screw stem.

4. The tool as claimed in claim 1, wherein the fixed jaw and the holding block are opposite to each other.

5. The tool as claimed in claim 1, wherein a second bolt is screwed into another side of the movable jaw; the first bolt and the second bolt respectively pass into the cavity from two sides thereof, and are thus able to respectively abut against and displace the retaining portion sidewards.

* * * * *